United States Patent [19]

Camp et al.

[11] Patent Number: 4,579,074

[45] Date of Patent: Apr. 1, 1986

[54] MAST STEP ASSEMBLY

[75] Inventors: Daniel Camp; Richard W. Grant; Ronald Sciulli, all of Honolulu, Hi.

[73] Assignee: ATECS Corporation, Honolulu, Hi.

[21] Appl. No.: 601,606

[22] Filed: Apr. 18, 1984

[51] Int. Cl.[4] ..... B63B 35/72

[52] U.S. Cl. ..... 114/39; 114/93

[58] Field of Search ..... 114/39.2, 93, 90, 204, 114/39.1; 244/118.6; 441/74; 403/323, 322, 316, 353; 248/222.3, 223.1, 503.1, 499; 410/75, 130, 150, 105, 115, 104

[56] References Cited

U.S. PATENT DOCUMENTS 3,356,325 12/1967 Schnase ..... 403/322
4,239,139 12/1980 Bott ..... 248/499

FOREIGN PATENT DOCUMENTS 3215668 10/1983 Fed. Rep. of Germany ..... 114/39.2
3230464 3/1984 Fed. Rep. of Germany ..... 114/39.2
2489237 3/1982 France ..... 114/93
8000689 9/1981 Netherlands ..... 114/93

OTHER PUBLICATIONS

European Patent Application, EP 83-106A, Curtet, Jul. 1983.

*Primary Examiner*—Galen Barefoot
*Assistant Examiner*—Edwin L. Swinehart
*Attorney, Agent, or Firm*—James C. Wray

[57] ABSTRACT

A quick-connect mast step assembly has a round main body bolted to the surface of a sail board wherein the upper surface of the body has a T-slot for receiving a mast shoulder bolt and a plug associated with the T-slot which, when rotated, prevents disengagement of the shoulder bolt from the T-slot, the body being bolted to a fin box in the upper surface of the sail board which allows easy adjustment of the position of the assembly.

14 Claims, 4 Drawing Figures

MAST STEP ASSEMBLY

BACKGROUND OF THE INVENTION

The invention disclosed herein relates generally to movable masts and, more specifically, to a mast step assembly for securing a mast to a sail board.

Conventional sail-powered boats or vessels have masts that are fixed in a vertical position by various forms of what are known as standing and running rigging. They are designed to maintain the vertical position of the mast relative to the hull or deck.

Sail boards, commonly referred to as "windsurfers", have masts which are not supported by rigging but are, instead, supported by a person standing on the windsurfer itself. The boards are usually provided with mast steps, which allow removal of the mast for transporting the board. After the mast has been stepped, it is generally free to pivot freely in order to facilitate positioning a sail properly in relationship to the direction of the wind. In other words, sail trim, which, on a conventional sailboat, requires changing the position of the sail, is accomplished on a windsurfer by changing the position of the sail and, also, changing the angle and direction of the mast.

It is important for sail boards to have a mast step, which allows quick stepping and easy adjusting, particularly since sail boards are transported usually on car tops.

SUMMARY OF THE INVENTION

The present invention provides a mast step assembly which provides for quick connection and disconnection and easy adjustment.

Unlike conventional sailing vessels, a sail board has a thin, flat and solid structure. Also, the board is long and narrow and is stood upon by the sailor. It is desirable, in order to effect proper sail trim, to move the heel of the mast for and aft, depending on the prevailing wind conditions and the point of sail. Therefore, in a preferred embodiment, the sail board is provided with a longitudinally extending, square groove into which is fitted what is commonly referred to as a "fin box". In cross section, the fin box appears as a box containing an inverted T-shaped groove. In other words, the fin box fits into the square groove in the sail board so that it is primarily flush with the upper surface of the sail board. The groove within the fin box extends downwardly or axially into the board and has a radially expanded portion at the end of the downwardly extending portion. The significance of the shape of the groove will be explained later.

In the preferred embodiment of the assembly, the assembly consists of a round main body, a round bottom plate, a mounting bolt and a mast shoulder bolt. The main body has a round, hollow space which extends from the underside into the body. The space is concentric with the body and has a smaller diameter. The bottom plate has a central bore which has an upper portion which is rectangular in shape when viewed from above but has sloping sides when viewed in cross section. An opposite portion of the bore has a radially expanded, rectangular or polygonally shaped space. The mounting bolt slides axially through the bore of the bottom plate until its head, having a shape conforming to the shape of the first portion of the bore, fits into the bore and is countersunk so that the top of the head is flush with the top of the bottom plate. A nut secures the bolt in place and becomes countersunk in the opposite portion of the bore, thereby preventing rotation of the bolt relative to the bottom plate. At this point, the bottom plate is fitted into the bottom of the body and is secured in place by screws. The screws prevent rotational movement of the bottom plate relative to the main body. As assembled, the mounting bolt extends axially downwardly from the main body and provides an axis of rotation for the body. The bolt is then inserted into the T-slot provided in the surface of the sail board. The bolt threadedly engages a rectangular, flat nut disposed within the expanded portion of the groove in the fin box. Prior to inserting the bolt into the fin box, a rubber gasket having the same diameter as the body is interposed between the body and the surface of the sail board. Rotational movement of the body causes rotational movement of the bolt which, after insertion into the fin box, engages the flat nut and causes axially downward movement of the body. Eventually, the body compresses the gasket between the underside of the body and the upper surface of the sailboard. The compression provides resistance to further rotation of the body and prevents the body from moving along the board. If it is desirable to change the position of the body, reverse rotation of the body loosens and decompresses the gasket so that the body and bolt can be moved axially in either direction along the surface of the sail board. When the desired position is attained, rotation of the body again tightens and compresses the gasket between the board and the body, thereby preventing movement of the body. The body is provided with a plurality of peripheral flutes which allow the body to be gripped by the sailor with a hand so that adjustments can be made easily and quickly without the use of torque-inducing tools, such as pliers or other wrenches.

The body is provided with a T-slot in the upper surface for receiving a shoulder bolt attached to a mast. The shoulder bolt can either be attached directly to the mast or indirectly through a rubber power joint. If a rubber power joint is used, the joint is preferably hourglass shaped in cross section and is fixedly attached to the heel of the mast at one end and threadedly engages the mast shoulder bolt at the other end. Preferably, a Teflon washer is interposed between the upper surface of the body and the lower surface of the rubber power joint. The power joint provides further pivotal movement of the mast.

While T-slots are known, the presently disclosed T-slot is completely novel. The slot, rather than having a small portion and a large portion, has a small, medium and large portion. In conventional T-slots, a bolt head or other rounded object fits into the larger portion axially and then is pushed radially into the smaller portion. The present T-slot has a third portion being larger than the second and first and into which is fitted a predominantly round plug. The plug has a crescent-shaped indentation in its outer periphery and is rotatably mounted on the top of the bottom plate by a shoulder bolt. It is important to note that a shoulder bolt has a threaded bottom portion and a headed top portion and an intermediate, cylindrical shoulder portion which enables, for instance, the bolt to be axially inserted into the plug, the threaded end being embedded into a supporting surface, such as the bottom plate, the plug being capable of rotating relative to the bolt itself about the shoulder portion thereof. When the plug is mounted as described above, the T-slot effectively comprises only two spaces: the smaller space in the center of the body and the larger space adjacent the smaller one. When the plug is rotated so that the crescent-shaped indentation faces the second larger space, the T-slot will consist of two overlapping, circular spaces, the interior walls of the second space being defined by the body and the crescent-shaped indentation in the plug. The second space, as described, has a diameter slightly larger than the diameter of the head of the mast shoulder bolt. In order to step the mast (the mast having a shoulder bolt, as described, axially downwardly extending from the heel of the mast or from a rubber power joint attached to the heel of the mast) the head of the bolt is inserted axially into the second space of the T-slot. The bolt is then pushed laterally inwardly into the smaller space, which has an expanded interior to accommodate the bolt head. In order to hold the shoulder bolt in position, the plug is rotated so that the crescent-shaped indentation no longer faces the second space. By doing so, the second space is drastically reduced in size and could no longer accommodate the head of the shoulder bolt. After rotation, the cylindrical wall of the plug nearly abuts the head of the bolt in order to maintain the position of the bolt in the first smaller space. In order to facilitate the rotation of the plug, the plug is provided with a lever, which is positioned in a slot provided in the outer periphery of the plug so that the lever extends laterally outwardly. In order to protect the lever, the body of the assembly has an arcuate depression, which effectively countersinks the plug lever into the surface of the body. When the plug is effectively "closed", i.e., the indentation is turned away from the second space, it is advantageous to provide the plug with a set screw which extends downwardly into a detent provided on the upper surface of the bottom plate. This prevents inadvertent rotation of the plug during sailing, which may lead to accidental unstepping of the mast.

It is an object of the present invention to provide a mast step for securing a mast to a sail board.

Another object of the invention is to provide a mast step which allows for quick connection of the mast to the sail board.

It is another object of the invention to provide a mast step which can be easily adjusted along the upper surface of the sail board.

Still another object of the invention is to provide a mast step which requires no tools to secure the mast.

Another object of the invention is to provide a quick-connect mast step assembly for securing a mast to a sail board, comprising a body having first connecting means for connecting the body to the sail board and second connecting means for connecting the mast to the body, wherein the first connecting means comrises a bolt extending downwardly from an underside of the body into a groove disposed longitudinally on an upper surface of the sail board, and a nut disposed within the groove, and wherein the second connecting means comprises a T-slot disposed at the upper surface of the body, a shoulder bolt having a headed portion extending downwardly from an axial end of the mast, the headed portion being receivable in an eccentric portion of the T-slot and movable to a central portion of the T-slot, and means for securing the shoulder bolt in the central portion of the T-slot, wherein the body further comprises a bottom plate receivable within the underside of the body, and the first connecting means comprises a bolt extending downwardly from the bottom plate, and wherein the body further comprises a stepped bore partially forming the T-slot, and the second connecting means further comprises a plug rotatably mounted on the upper surface of the bottom plate and within the eccentric portion of the T-slot, the plug having a mostly cylindrical side wall for holding the shoulder bolt in the centric portion of the T-slot, and a crescent-shaped indentation which, when aligned with the centric portion of the T-slot, defines a space for receiving the shoulder bolt.

Other features and advantages of the invention will become apparent from the following description of specific embodiments of the mast step.

DETAILED DESCRIPTION OF THE DRAWINGS

Figure 1:
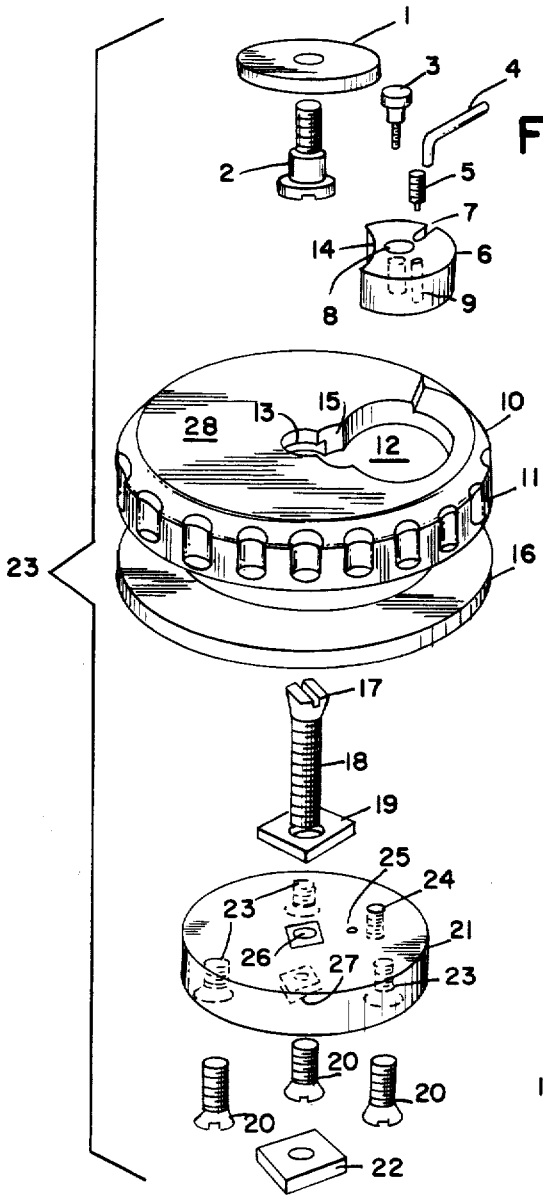
FIG. 1 is an exploded view of the mast step assembly.

Referring to the drawings, in FIG. 1, the basic assembly is shown as number 23. A body 10 is basically round and has a flat upper surface. The upper surface of the body is provided with a T-slot which, in an unassembled form, comprises three separate spaces. Each of the spaces is circular in shape. Inner space 13 is centrically located on the body. Middle space 15 overlaps with inner space 13 and has a greater diameter. Outer space 12 overlaps with middle space 15 and has an even larger diameter. The three spaces are radially aligned. A round bottom plate 21 fits into the underside of the body 10. The bottom plate 21 is provided with an axial bore 26 and apertures 23, which receive screws 20 for securing the bottom plate within the body. The central bore 26 has a rectangularly shaped upper portion, which has significance to be explained later. Prior to assembling the body 10 and bottom plate 21, a mounting bolt 18 is inserted into the axial bore of the bottom plate until the head 17 of the bolt 18 becomes snugly fitted into a countersunk portion of the axial bore. The head 17 is provided with two flat, opposed sides, which conform to the rectangular shape of the countersunk portion of the bore 26. The bore, furthermore, is shaped so that the head is countersunk into the bottom plate, as shown in either FIG. 3 or 4. The shape of the head conforming to the shape of the bore prevents relative rotation of the bottom plate relative to the bolt. In order to prevent relative axial movement, a nut 19 threadedly engages the bolt and becomes countersunk into a depressed area 27 in the lower portion of the bore. In FIG. 1, the depressed area 27 is shown by broken lines since it is not visible from the angle shown.

Figure 3:
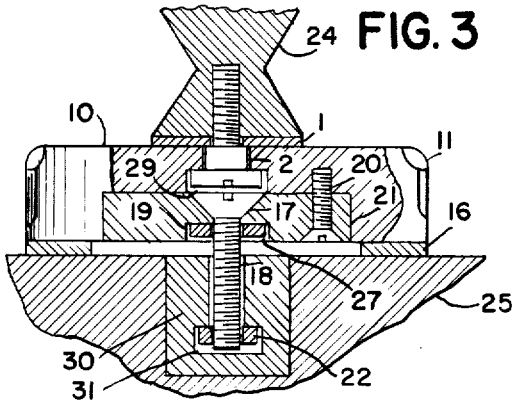
FIG. 3 is a cross-sectional view of the assembled mast step taken along lines A—A of FIG. 2.
Figure 4:
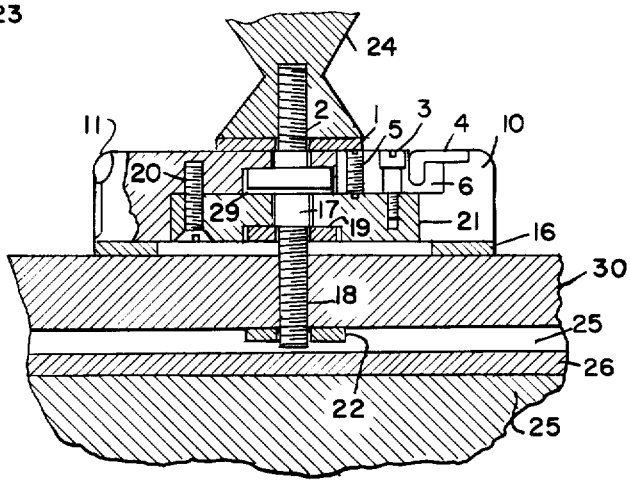
FIG. 4 is a cross-sectional viewing taken along lines B—B of FIG. 2.

After the mounting bolt 18 is secured by bolt 19 to the bottom plate 21, the bottom plate is inserted into the underside of the body 10 and is fixed in place by screws 20, as seen in FIGS. 3 and 4. A basically round plug 6 is inserted into the outer space 12 and is rotatably mounted to the bottom plate by a plug shoulder bolt 3. The mounting of the plug is best shown in FIG. 4. The plug, referring back to FIG. 1, has a central bore 8 for receiving the shoulder bolt 3 and a crescent-shaped indentation 14 in the outer periphery. Furthermore, the plug has a set screw 5 received in a bore 9 which protrudes beyond the bottom surface of the plug so as to make contact with a detent 25 in the upper surface of the bottom plate 21. Prior to stepping the mast, the plug is rotated to a position such that the crescent-shaped, indentation 14 faces the middle space 15 so that the middle space 15 becomes a more or less circular space. The significance of the positioning of the crescent-shaped indentation will be explained later.

In a preferred embodiment of the present invention, a sail board is provided with a rectangular groove which runs axially or fore and aft. As shown in FIG. 3, a fin box 30 is secured into the rectangular groove. The fin box 30 provides a T-shaped groove for receiving the mounting bolt of the mast step assembly. As shown in FIG. 3, the mounting bolt 18 extends axially downwardly from the body 10 and is placed into the T-shaped groove 31 of the fin box 30. The mounting bolt 18 threadedly engages a rectangular flat nut 22 disposed within an interior expanded portion of the groove 31. When the body is rotated, the bottom plate and mounting bolt rotate with the body. As the bolt rotates, the nut 22 advances axially up the bolt 18, thereby drawing the body 10 toward the sail board 25. A rubber gasket 16, having a diameter equal to that of the body 10, is interposed between the sail board 25 and the body 10 so that it becomes compressed between the sail board and the body, thereby providing resistance to further rotation and means for the body to grip the board. The body is designed to be rotated by hand. In order to facilitate hand rotation, the outer periphery of the body 10 is provided with a plurality of flutes 11. The position of the mast step assembly can be changed by loosening the body with reverse rotation, sliding the body to the desired position, and then re-rotating until the gasket becomes compressed again. In FIG. 4, it is shown that the body can be repositioned either left or right of its illustrated position, according to the length of the fin box. The length of the fin box is determined by the design of the board and is not a part of what is claimed herein.

Figure 2:
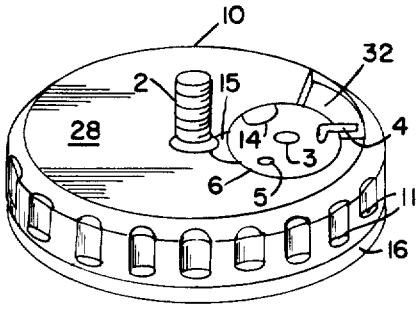
FIG. 2 is an elevated view of the assembled mast step.

Once the mast step assembly is secured to the sail board, a mast may be stepped by providing in the heel of the mast a mast shoulder bolt 2 which extends either axially into the heel of the mast or into a rubber power joint 24, which is secured to the heel of the mast. If a power joint 24 is interposed between the mast and the body, it is preferable to insert a nylon washer 1 between the power joint 24 and the upper surface 28 of the body 10. In either case, the shoulder and head of the mast shoulder bolt extend axially downwardly from the heel of the mast. To step the mast, the plug in the outer space of the T-slot is positioned so that the crescent-shaped indentation 14 faces the middle space 15. The head of the shoulder bolt is axially inserted into the middle space 15 until it approximately abuts the upper surface of the bottom plate 21. The mast shoulder bolt 2 is then pushed radially inwardly until the shoulder portion of the mast shoulder bolt occupies the inner space 13. The diameter of the shoulder portion is slightly smaller than the diameter of the inner space 13 to effect a more or less snug fit. Below the surface of the body 10, an expanded portion 29 receives the head of the shoulder bolt 2. In order to prevent removal of the shoulder bolt 2 from the inner space 13, the plug 6 is rotated so that the crescent-shaped indentation becomes completely removed from the middle space 15. It is shown in FIG. 2 that, when the plug is so rotated, the middle space 15 becomes drastically reduced in size, thereby making it impossible for the bolt 2 to be axially removed therefrom. As shown in FIG. 4, the plug 6 also prevents lateral movement of the bolt 2 by having the outer cylindrical surface of the plug 6 nearly abut the head of the shoulder bolt 2. In order to prevent accidental rotation of the plug which might lead to accidental unstepping of the mast, it was previously pointed out that the plug is provided with a set screw 5, which extends downwardly into a detent 25 formed in the upper surface of the bottom plate 21. When the plug is positioned as shown in FIG. 2, it can be seen in FIG. 4 that the set screw 5 and detent 25 axially align to provide torque-resisting means. The handle 4 provided on the plug 6 facilitates the hand rotation of the plug. The upper surface 28 of the body 10 is provided with an arcuate depression 32 for receiving the handle 4. This allows the handle to be recessed into the body and thereby out of the way.

While the invention has been described with reference to specific embodiments, modifications and variations of the invention may be made without departing from the scope of the invention which is defined in the following claims.

We claim:

1. A quick-connect mast step assembly for securing a mast to a sail board, comprising a body having first connecting means for connecting the body to the sail board and second connecting means for connecting the mast to the body, wherein the first connecting means comprises a bolt extending downwardly from an underside of the body into a groove disposed longitudinally on an upper surface of the sail board, and a nut disposed within the groove, and wherein the second connecting means comprises a T-slot disposed at the upper surface of the body, a shoulder bolt having a headed portion extending downwardly from an axial end of the mast, the headed portion being receivable in an eccentric portion of the T-slot and movable to a central portion of the T-slot, and means for securing the shoulder bolt in the central portion of the T-slot.

2. The apparatus of claim 1 wherein the body further comprisies a bottom plate receivable within the underside of the body, and the first connecting means comprises a bolt extending downwardly from the bottom plate.

3. The apparatus of claim 2 wherein the body further comprises a stepped bore partially forming the T-slot, and the second connecting means further comprises a plug rotatably mounted on the upper surface of the bottom plate and within the eccentric portion of the T-slot, the plug having a mostly cylindrical side wall for holding the shoulder bolt in the centric portion of the T-slot, and a crescent-shaped indentation which, when aligned with the centric portion of the T-slot, defines a space for receiving the shoulder bolt.

4. The apparatus of claim 3 wherein the plug further comprises detent means for preventing rotation of the plug after the shoulder bolt has been positioned in the centric portion of the T-slot.

5. The apparatus of claim 4 wherein the plug further comprises a handle extending radially outwardly from the plug and being slideable within an arcuate depression provided in an upper surface of the body.

6. The apparatus of claim 1 wherein the groove has an inverted T-shape in cross section, wherein the nut disposed in the groove is prevented from rotating by abutting sidewalls of the groove.

7. The apparatus of claim 1 wherein the body is round and fluted at the peripheral edges.

8. The apparatus of claim 1 further comprising a resilient washer interposed between an upper surface of the body and a rubber power joint connected at an axial end of the mast.

9. The apparatus of claim 1 further comprising a rubber gasket interposed between an upper surface of the sail board and a lower surface of the body.

10. A mast stepping device for securing a mast to a sail board comprising a round main body, a round bottom plate corresponding in size to a cavity formed in an underside of the main body, the bottom plate having a central axial bore through which passes a threaded and headed mounting bolt, the head being countersunk into an upper surface of the bottom plate, the head having two flat surfaces which correspond to flat surfaces in the countersunk portion to prevent rotational movement of the bolt relative to the bottom plate, and the threads engaging a nut which becomes countersunk into a lower surface of the bottom plate, the nut preventing axial movement of the bolt relative to the bottom plate, the bottom plate being inserted into the cavity formed in the underside of the main body and fixedly attached therein by retaining screws so that the main body, bottom plate, nut and bolt rotate in unison, the mounting bolt extending downwardly into a fin box disposed longitudinally along an upper surface of the sail board, the fin box providing an inverted T-shaped groove in the sail board, a flat nut disposed within the fin box for threadedly engaging the mounting bolt, and a T-slot having an eccentric, circular opening into which a mast shoulder bolt is axially inserted, the shoulder bolt being connected to a rubber power joint and being radially movable to a central circular opening in the body so that the shoulder bolt extends axially upwardly from the central circular opening.

11. The assembly of claim 10 wherein a washer is interposed the lower surface of the main body and the upper surface of the sailboard.

12. The assembly of claim 10 wherein the T-slot comprises a first circular space coaxial with the axis of the main body, a second circular space of greater diameter than the first, and a third circular space of greater diameter than the second, the first, second and third circular spaces being radially aligned with and intersecting each other, and the assembly further comprising a circular plug rotatably mounted on the upper surface of the body, the plug fitting into the third circular space and having a crescent-shaped, radial indentation approximately equal to the amount of overlap between the intersecting second and third circular spaces so that, when the plug is rotated to a point where the crescent-shaped, radial indentation faces the second circular space, the main body and the plug together define the second circular space which provides an opening for the mast shoulder bolt, which is pushed radially inwardly to the first circular space, the plug then being rotated so that the crescent-shaped indentation no longer faces the second circular space, the rotation thereby preventing radial movement of the shoulder bolt away from the center by having an outer cylindrical wall of the plug abut the head of the shoulder bolt.

13. The assembly of claim 10 further comprising a set screw extending through the plug and engaging a detent in the upper surface of the bottom plate to prevent inadvertent rotation of the plug.

14. The assembly of claim 10 further comprising an L-shaped handle fitted into an elongated U-shaped peripheral groove in the plug for hand gripping and rotating the plug.

* * * * *